US007819665B1

(12) United States Patent
Nishizawa

(10) Patent No.: US 7,819,665 B1
(45) Date of Patent: Oct. 26, 2010

(54) ROTATING ELECTRIC CONNECTOR ASSEMBLY

(76) Inventor: John Nishizawa, 88 Rutherford La., Martinez, CA (US) 94553

( * ) Notice: Subject to any disclaimer, the term of this patent is extended or adjusted under 35 U.S.C. 154(b) by 0 days.

(21) Appl. No.: 12/722,866

(22) Filed: Mar. 12, 2010

(51) Int. Cl.
*H01R 39/00* (2006.01)

(52) U.S. Cl. ..... 439/13

(58) Field of Classification Search ..... 439/13, 439/17, 21, 22, 24, 25
See application file for complete search history.

(56) References Cited

U.S. PATENT DOCUMENTS

| | | | | |
|---|---|---|---|---|
| 4,583,798 | A | 4/1986 | Blazowich | |
| 4,753,600 | A | 6/1988 | Williams | |
| 4,904,189 | A | 2/1990 | Hallings | |
| 4,932,882 | A | 6/1990 | Kang | |
| 5,352,122 | A * | 10/1994 | Speyer et al. | 439/13 |
| 5,399,093 | A | 3/1995 | Schneider et al. | |
| 5,429,518 | A | 7/1995 | Chen | |
| 5,468,912 | A | 11/1995 | Zalewski | |
| 5,595,503 | A | 1/1997 | Pittman et al. | |
| 6,015,307 | A | 1/2000 | Chiu et al. | |
| 6,068,490 | A * | 5/2000 | Salzberg | 439/25 |
| 6,077,086 | A | 6/2000 | LaRoche | |
| 6,190,180 | B1 * | 2/2001 | Purington et al. | 439/17 |
| 6,638,074 | B1 | 10/2003 | Fisher | |
| 7,101,187 | B1 | 9/2006 | Deconinck et al. | |
| 7,214,102 | B2 | 5/2007 | Chong | |
| 7,462,074 | B1 | 12/2008 | Devlin et al. | |
| 7,559,790 | B2 | 7/2009 | Boeck et al. | |

* cited by examiner

*Primary Examiner*—Chandrika Prasad
(74) *Attorney, Agent, or Firm*—Charles L. Thoeming

(57) ABSTRACT

A rotating electric connection socket assembly includes a rotatable housing assembly having a plurality of non-conductive cylindrical housings nested about a longitudinal axis. Separate rotatable electrical contacts housed within the rotatable housing assembly provide electrical connectivity between a three prong plug on one rotatable housing assembly end and a three prong receptacle on the other rotatable housing assembly end.

14 Claims, 4 Drawing Sheets

ROTATING ELECTRIC CONNECTOR ASSEMBLY

CROSS-REFERENCES TO RELATED APPLICATIONS

None.

STATEMENT REGARDING FEDERALLY SPONSORED RESEARCH OR DEVELOPMENT

None.

REFERENCE TO A MICRO-FICHE APPENDIX

None.

TECHNICAL FIELD

This invention relates to an electrical connector for use with conventional electrically powered hand tools which may be moved in a circular motion such as a counterclockwise direction during use as may be required in manufacturing or maintenance operations. The invention can be for example connected between the electrical supply cord of the hand tool and a drop cord connected to a power source to prevent the supply cord from twisting and possibly being damaged as the tool is directed continuously in circles.

BACKGROUND OF THE INVENTION

Attempts have been made in the past to prevent electrical supply cords from twisting and being damaged by operators who must direct power hand tools in continuous circular patterns. For example, in the manufacture of round table tops, jigsaws are often employed to cut wood or ply-board and such materials may be cut with a hand-held electrical jigsaw in a continuous counterclockwise direction. After one or more tops are cut the operator must stop and untwist the electrical supply cord which may be suspended from an overhead power source. In use, after sufficient twisting has occurred, the power supply or drop cord may be damaged and has to be repaired or replaced at great expense. Continuous circular movement of power hand tools normally occurs in furniture manufacturing, cloth cutting in garment plants and in other types of manufacturing and maintenance facilities.

With the known problems associated with electrical supply cord twisting, the present invention was conceived and one of its objectives is to provide a rotatable electrical connector which is easy to install between an electrical supply cord and a power hand tool and which can be readily adapted to a variety of power hand tool uses.

It is another objective of the present invention to provide a rotatable electrical connector which is relatively simple in construction yet which will provide convenience to the user and will prevent windings in supply cords when a hand tool is operated in a circular direction.

It is still another objective of the present invention to provide a rotatable electrical connector for electrical supply cords which can be easily manufactured for various voltages and which is equipped with a ground wire.

While the apparatus has been, or will be, described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112.

Any feature or combination of features described herein are included within the scope of the present invention provided that the features included in any such combination are not mutually inconsistent as will be apparent from the context, this specification, and the knowledge of one skilled in the art. For purposes of summarizing the present invention, certain aspects, advantages and novel features of the present invention are described herein. Of course, it is to be understood that not necessarily all such aspects, advantages or features will be embodied in any particular embodiment of the present invention. Additional features, advantages, objects and aspects of the present invention are apparent in the following detailed description, accompanying drawings, and claims that follow.

DISCLOSURE OF INVENTION

A rotating electric connection socket assembly includes a rotatable housing assembly having a non-conductive first internal cylindrical housing with two ends, and a first conductive band around an outer second end surface. The rotatable housing assembly further includes a non-conductive second internal cylindrical housing with two ends. A non-conductive first external cylindrical housing is provided as part of the rotatable housing assembly and the first external cylindrical housing includes a locking first end, a second end, and a second conductive band around the outer second end surface, and conductive bearings communicating with the first internal cylindrical housing conductive band external cylindrical housing conductive band. A three prong electrical plug is locked into and housed in external cylindrical housing locking first end. The rotatable housing assembly also includes a non-conductive second external cylindrical housing including a first end and a locking second end. A three prong electrical receptor is housed in the second external cylindrical housing locking second end. A non-conductive third external cylindrical housing includes a first end and a locking second end, and sized to receive and connectably house the first external cylindrical housing second end and the second external cylindrical housing first end. The assembled cylindrical housing members are aligned along a central longitudinal axis.

Longitudinal 360 degree rotational electrical connection about the central longitudinal axis for a first contact isolated and rotatable longitudinal electrical element is provided by an embodiment of rotating electric connection assembly having a conductive central bearing assembly providing a conductive first end of central bearing assembly and a conductive second end of central bearing assembly, and a longitudinal annular central channel centered on the central longitudinal axis. A first lead with one end attached to the conductive first end of central bearing assembly and a second end attached to the three prong electrical receptor, and a second lead with one end attached to the conductive second end of central bearing assembly and a second end attached to the three prong electrical plug complete the electrical connection for the first contact element from the three prong electrical plug through the length of the embodiment of rotating electric connection assembly to the prong electrical receptor. As the embodiment of rotating electric connection assembly is rotated about its longitudinal axis, the central bearing provides first contact element conductivity continuity throughout the embodiment of rotating electric connection assembly by allowing separate rotation of the first cylinder connector housing and the second cylinder connector housing and the separate leads contained within the housings while maintaining contact with the attached ends of the leads. The first isolated and rotatable longitudinal electrical contact assembly comprising two ends is housed in the non-conductive first internal cylindrical housing and the non-conductive second internal cylindrical housing.

Longitudinal 360 degree rotational electrical connection for a second isolated and rotatable longitudinal electrical contact element is provided by an embodiment of rotating electric connection assembly, having a nonconductive internal channel providing dual rotor bearing assemblies within conductive housings and insulated covers, and attached to the three prong electrical plug and the three prong electrical receptor. The outside diameter of the non-conductive internal cylinder is sized to be received and held by the central bearing assembly longitudinal annular central channel aligned on central longitudinal axis of the rotating electric connection assembly. The non-conductive internal cylinder has a longitudinally disposed channel sized to receive an externally threaded conductive rod secured by threaded bolts on both ends of the conductive rod and non-conductive internal cylinder. Threaded conductive housings are threaded onto each end of the conductive rod extending beyond the threaded bolts and secured by fasteners. Insulated covers are provided for conductive housings. Internal channel rotor bearing assemblies provide second contact element conductivity continuity throughout the embodiment of rotating electric connection assembly by allowing separate rotation of the first cylinder connector housing and the second cylinder connector housing while maintaining contact with the threaded conductive housings.

One end of each internal channel rotor bearing assembly is sized to be received into and secured by the ends of the threaded conductive housings not threaded onto conductive rod. The other end of each the internal channel rotor bearing assembly is sized to be received by and secured to a conductive housing having a conductive lead. Each such assembled conductive housing is enclosed in insulated covers. The second isolated and rotatable longitudinal electrical contact element and assembly is housed in the non-conductive first internal cylindrical housing and the non-conductive second internal cylindrical housing.

Longitudinal 360 degree rotational electrical connection for a third contact element is provided by an embodiment of rotating electric connection assembly having a conductive lead providing one end connected to a conductive band on the external surface of a cylinder housing and a second end connected to the three prong electrical plug. A second conductive lead has one end connected to a conductive band on the external surface of internal cylinder housing and a second end connected to the three prong electrical receptor. Connective band contacts conductive band by conductive bearings. In this assembly, third contact element conductivity continuity is provided throughout the embodiment of rotating electric connection assembly by allowing separate rotation of the first cylinder connector housing and cylinder housing.

While the apparatus has been, or will be, described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112.

Any feature or combination of features described herein are included within the scope of the present invention provided that the features included in any such combination are not mutually inconsistent as will be apparent from the context, this specification, and the knowledge of one skilled in the art. For purposes of summarizing the present invention, certain aspects, advantages and novel features of the present invention are described herein. Of course, it is to be understood that not necessarily all such aspects, advantages or features will be embodied in any particular embodiment of the present invention. Additional features, advantages, objects and aspects of the present invention are apparent in the following detailed description, accompanying drawings, and claims that follow.

BRIEF DESCRIPTION OF DRAWINGS

The above stated features, aspects, and advantages of the rotating electric connection socket assembly will become better understood with regard to the following description, appended claims, and accompanying drawings as further described.

Figure 3:
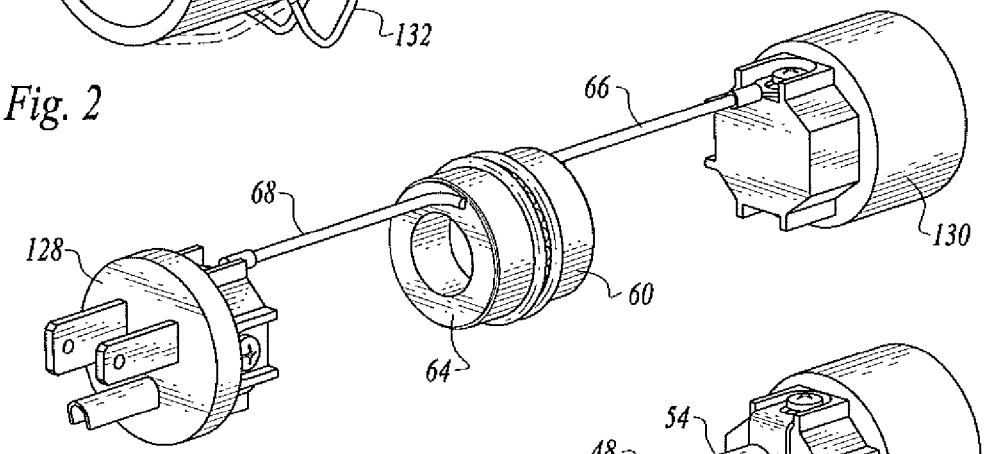
FIG. 3 is a perspective view of a longitudinal 360 degree rotational electrical connection for a first contact element of an embodiment of rotating electric connection assembly 10, depicting a central bearing assembly 60 having a conductive first end of central bearing assembly 62 (not shown) and a conductive second end of central bearing assembly 64 and having a first lead 66 with one end attached to the conductive first end of central bearing assembly 62 (not shown) and a second end attached to the three prong electrical receptor 130, and a second lead 68 with one end attached to the conductive second end of central bearing assembly 64 and a second end attached to the three prong electrical plug 128.
Figure 8:
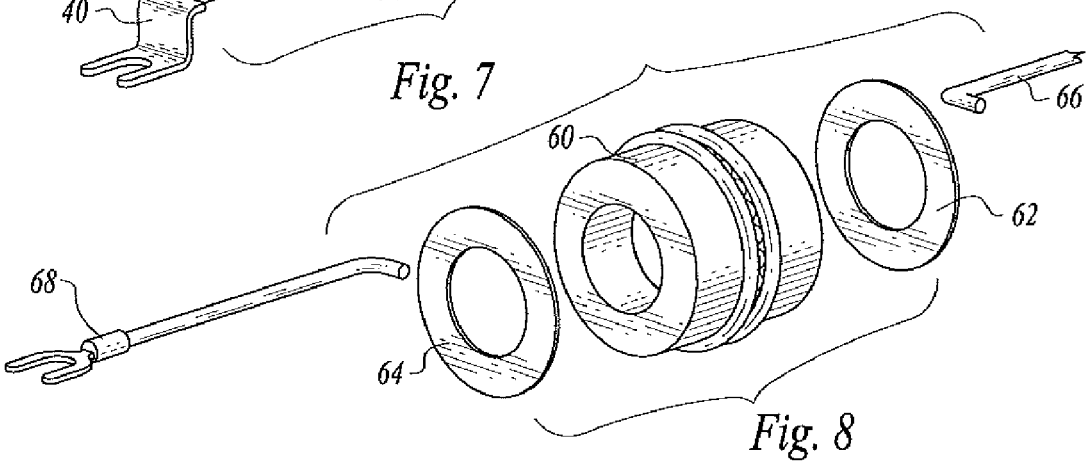

FIG. 8 is an exploded isometric detail view of central bearing assembly 60 having a conductive first end of central bearing assembly 62 and a conductive second end of central bearing assembly 64 and having a first lead 66 with one end attached to the conductive first end of central bearing assembly 62 and a second lead 68 with one end attached to the conductive second end of central bearing assembly 64 of FIG. 3 for an embodiment of rotating electric connection assembly 10.

Figure 4:
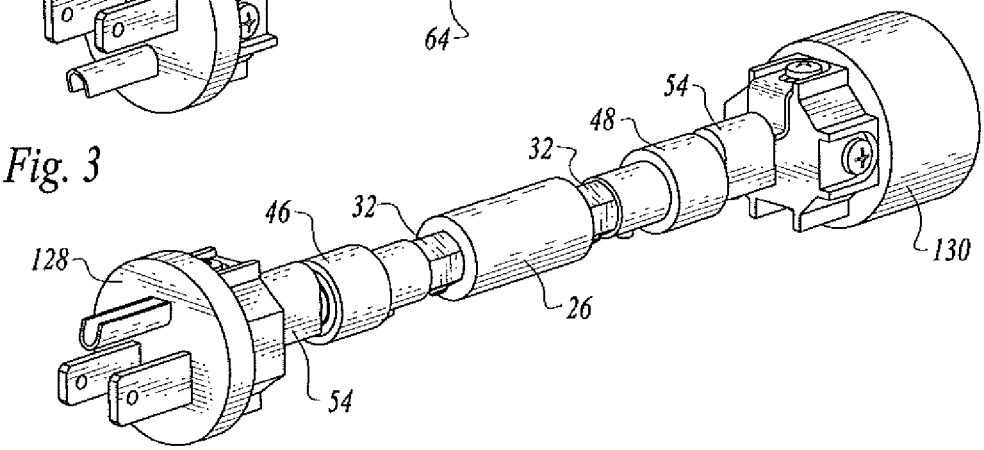
FIG. 4 is a perspective view of a longitudinal 360 degree rotational electrical connection for a second contact element of an embodiment of rotating electric connection assembly 10, depicting an internal non-conductive channel insulated cover 36 having dual rotor bearing assemblies within conductive housings 46, 48 and 54 attached to the three prong electrical plug 128 and the three prong electrical receptor 130, respectively.
Figure 9:
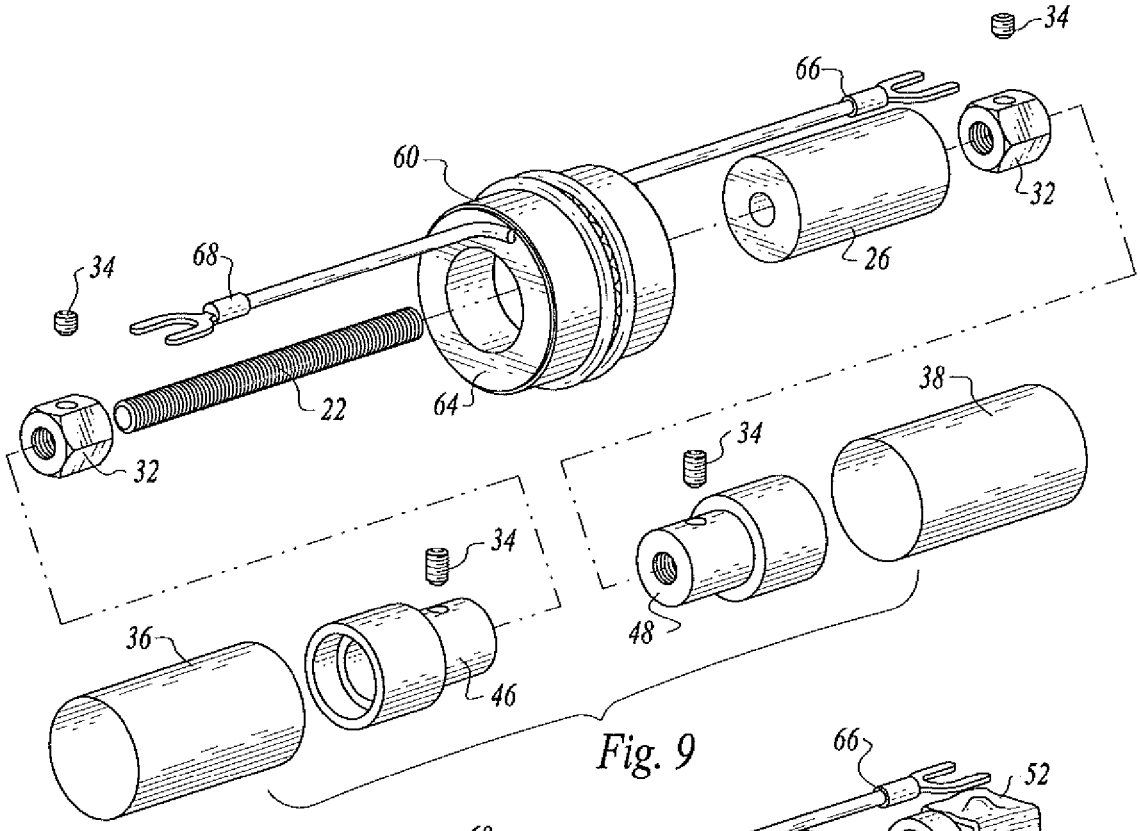
Figure 10:
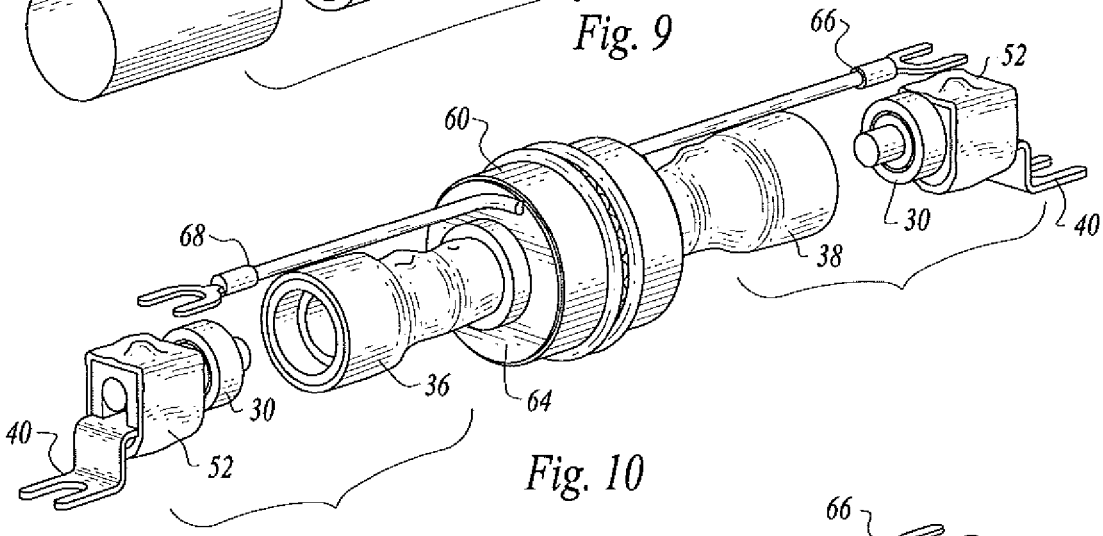

FIG. 9 is a partial exploded isometric detail view of the elements of FIGS. 3, 4 and 10 for an embodiment of rotating electric connection assembly 10.

Figure 7:
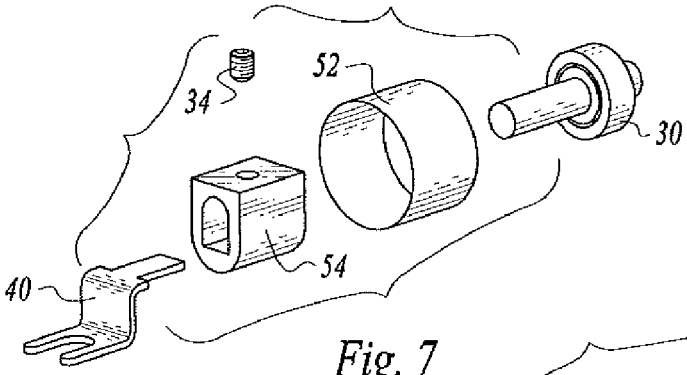
FIG. 7 is an exploded isometric detail view of a representative rotor bearing assembly shaft 30, an insulted cover 52 for a conductive housing 54, a hexagonal top threaded fastener 34, and a connection lead 40 of FIG. 4 for an embodiment of rotating electric connection assembly 10.

FIG. 10 is a partial exploded isometric detail view of the assembled elements of FIGS. 7, 8 and 9 for an embodiment of rotating electric connection assembly 10.

Figure 11:
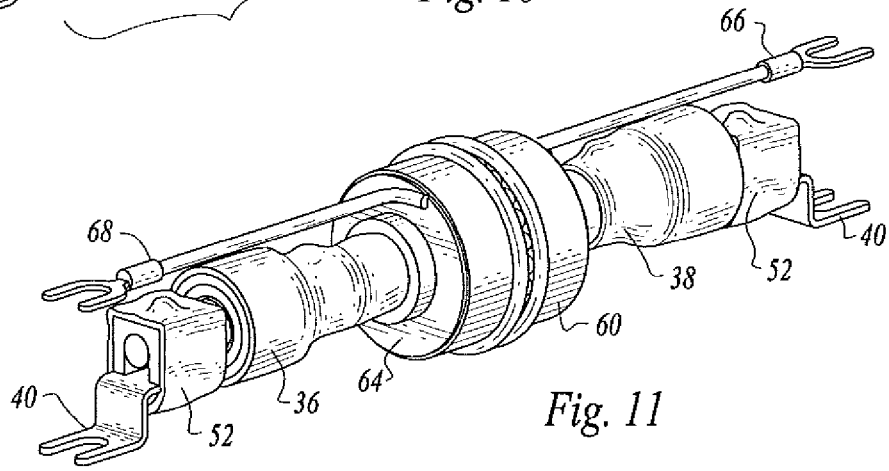

FIG. 11 is an assembled perspective view of the elements of FIG. 10 for an embodiment of rotating electric connection assembly 10.

Figure 1:
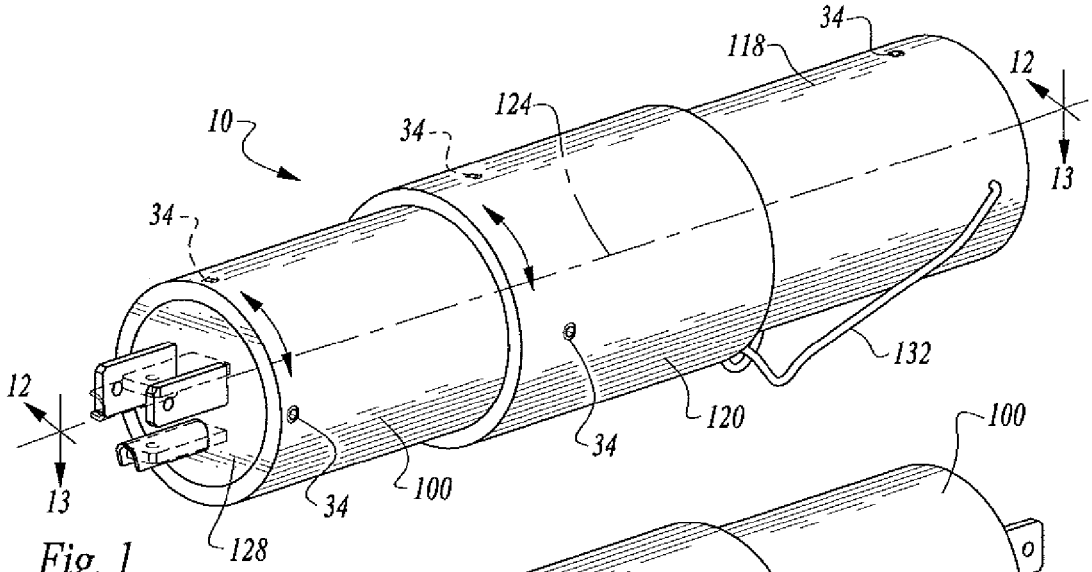
FIG. 1 is a perspective view of an embodiment of rotating electric connection assembly 10 ready for use by plugging the three prong electrical plug 128 into a standard three prong electrical outlet (not shown) or the three prong electrical receptor of an electrical drop cord (not shown).
Figure 12:
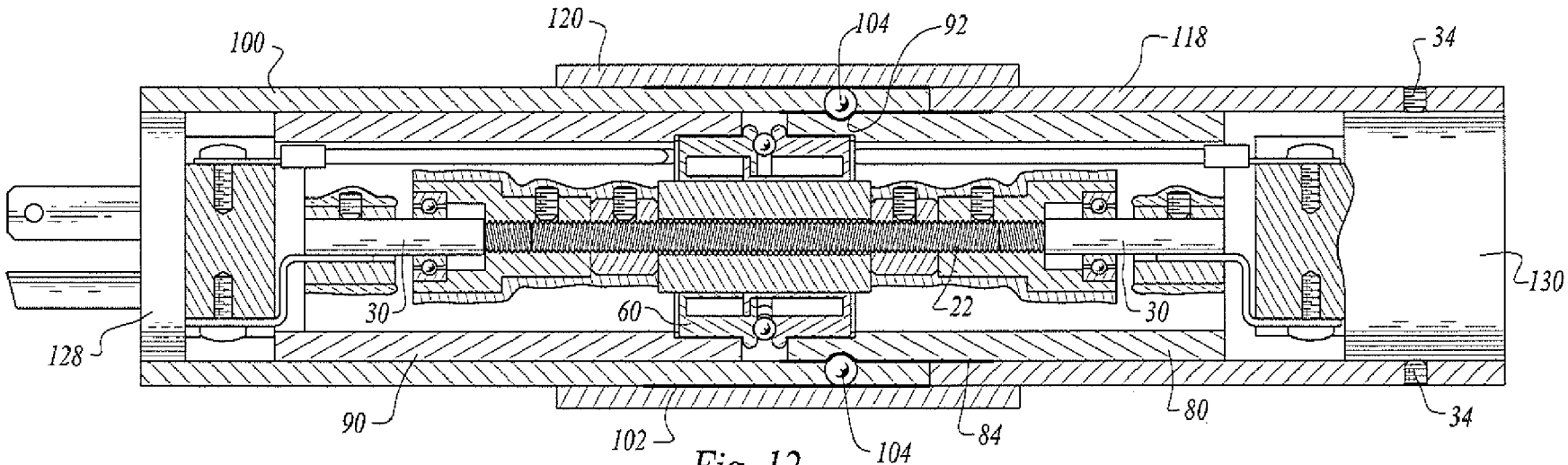

FIG. 12 is a sectional view of FIG. 1 taken at "12-12."

Figure 13:
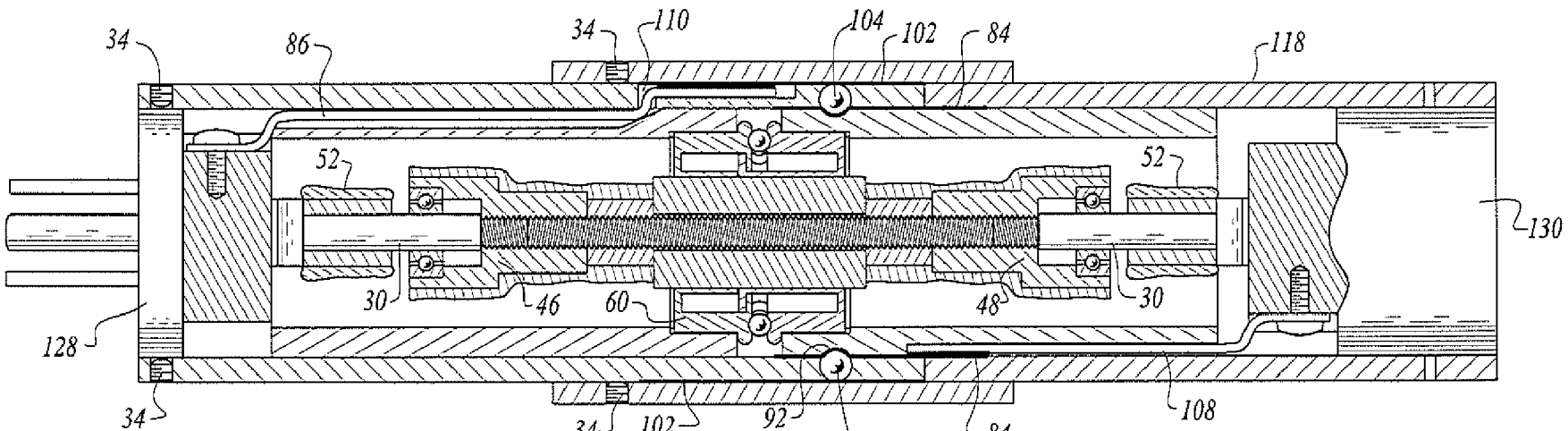

FIG. 13 is a sectional view of FIG. 1 taken at "13-13."

BEST MODE FOR CARRYING OUT THE INVENTION

The following discussion describes in detail various embodiments of the rotating electric connection assembly. This discussion should not be construed, however, as limiting the rotating electric connection assembly to those particular embodiments. Practitioners skilled in the art will recognize numerous other embodiments as well. For a definition of the complete scope of the rotating electric connection assembly, the reader is directed to the appended claims.

FIGS. 1-13 depict various embodiments of the rotating electric connection assembly 10. The rotating electric connection assembly 10 is shown fully assembled and ready for use in FIGS. 1 and 2, where a typical electrical cord (not shown) with a three prong plug (not shown) can be plugged into the three prong electrical receptor 130 locked into in one end of the rotating electric connection assembly 10, FIGS. 2, 12 and 13, and held in locked position onto the three prong electrical receptor 130 by the swivel, locking element for three prong electrical receptor 132.

A rotating electric connection socket assembly 10 includes a rotatable housing assembly having a non-conductive first internal cylindrical housing 80 with two ends, and a first conductive band 84 around an outer second end surface, FIGS. 5, 6, 12 and 13. The rotatable housing assembly further includes a non-conductive second internal cylindrical housing 90 with two ends, FIGS. 5, 6, 12 and 13. A non-conductive first external cylindrical housing 100 is provided as part of the rotatable housing assembly and the first external cylindrical housing 100 includes a locking first end, a second end, and a second conductive band 102 around the outer second end surface, and conductive bearings 104 communicating with the first internal cylindrical housing conductive band 84 external cylindrical housing conductive band 102. A three prong electrical plug 128 is locked into and housed in external cylindrical housing 100 locking first end, FIGS. 1, 5, 12 and 13. The rotatable housing assembly also includes a non-conductive second external cylindrical housing 118 including a first end and a locking second end, FIGS. 1, 2, 5, 12 and 13. A three prong electrical receptor 130 is locked into and housed in the second external cylindrical housing 118 locking second end, FIGS. 2, 5, 12 and 13. A non-conductive third external cylindrical housing 120 includes a first end and a locking second end, and sized to receive and connectedly house the first external cylindrical housing 100 second end and the second external cylindrical housing 118 first end, FIGS. 1, 2, 12 and 13. Cylindrical housings 80, 90, 100, 118, and 120 are aligned along the central longitudinal axis 124 of the rotating electric connection assembly 10.

Longitudinal 360 degree rotational electrical connection about the central longitudinal axis 124 for a first contact isolated and rotatable longitudinal electrical element is provided by an embodiment of rotating electric connection assembly 10, depicting a conductive central bearing assembly 60 having a conductive first end of central bearing assembly 62 and a conductive second end of central bearing assembly 64, FIGS. 3 and 8, and an longitudinal annular central channel centered on the central longitudinal axis 124. A first lead 66 with one end attached to the conductive first end of central bearing assembly 62 and a second end attached to the three prong electrical receptor 130, and a second lead 68 with one end attached to the conductive second end of central bearing assembly 64 and a second end attached to the three prong electrical plug 128 complete the electrical connection for the first contact element from the three prong electrical plug 128 through the length of the embodiment of rotating electric connection assembly 10 to the prong electrical receptor 130, FIGS. 1-3, and 8. As the embodiment of rotating electric connection assembly 10 is rotated about its longitudinal axis 124, the central bearing 60 provides first contact element conductivity continuity throughout the embodiment of rotating electric connection assembly 10 by allowing separate rotation of the first cylinder connector housing 100 and the second cylinder connector housing 118 and the separate leads, 68 and 66, respectively, contained within the housings 100 and 118 while maintaining contact with the attached ends of the leads, 68 and 66. The first isolated and rotatable longitudinal electrical contact assembly comprising two ends is housed in the non-conductive first internal cylindrical housing 80 and the non-conductive second internal cylindrical housing 90.

Longitudinal 360 degree rotational electrical connection for a second isolated and rotatable longitudinal electrical contact element is provided by an embodiment of rotating electric connection assembly 10, having a nonconductive internal channel 26 having dual rotor bearing assemblies 30 and 42 within conductive housings 46 and 48 and insulated covers 36 and 38 attached to the three prong electrical plug 128 and the three prong electrical receptor 130, respectively, FIGS. 4, 7, and 9-12. The outside diameter of the non-conductive internal cylinder 26 is sized to be received and held by the central bearing assembly 64 longitudinal annular central channel, FIGS. 8-11, aligned on central longitudinal axis 124 of the rotating electric connection assembly 10. The non-conductive internal cylinder 26 has a longitudinally disposed channel sized to receive an externally threaded conductive rod 22 secured by threaded bolts 32 on both ends of the conductive rod 22 and non-conductive internal cylinder 26, FIGS. 4 and 9. Threaded conductive housings 46 and 48 are threaded onto each end of the conductive rod 22 extending beyond the threaded bolts 32 and secured by fasteners 34. Insulated covers 36 and 38 are provided for conductive housings 46 and 48, respectively. Internal channel rotor bearing assemblies 30 provide second contact element conductivity continuity throughout the embodiment of rotating electric connection assembly 10 by allowing separate rotation of the first cylinder connector housing 100 and the second cylinder connector housing 118 while maintaining contact with the threaded conductive housings 46 and 48, FIGS. 4, 7 and 9-12.

One end of each internal channel rotor bearing assembly 30 is sized to be received into and secured by the ends of the threaded conductive housings 46 and 48 respectively, not threaded onto conductive rod 22, FIGS. 7 and 9. The other end of each the internal channel rotor bearing assembly 30 is sized to be received by and secured to a conductive housing 54 having a conductive lead 40. Each such assembled conductive housing 54 is enclosed in insulated covers 52. The second isolated and rotatable longitudinal electrical contact element and assembly is housed in the non-conductive first internal cylindrical housing 80 and the non-conductive second internal cylindrical housing 90.

Figure 5:
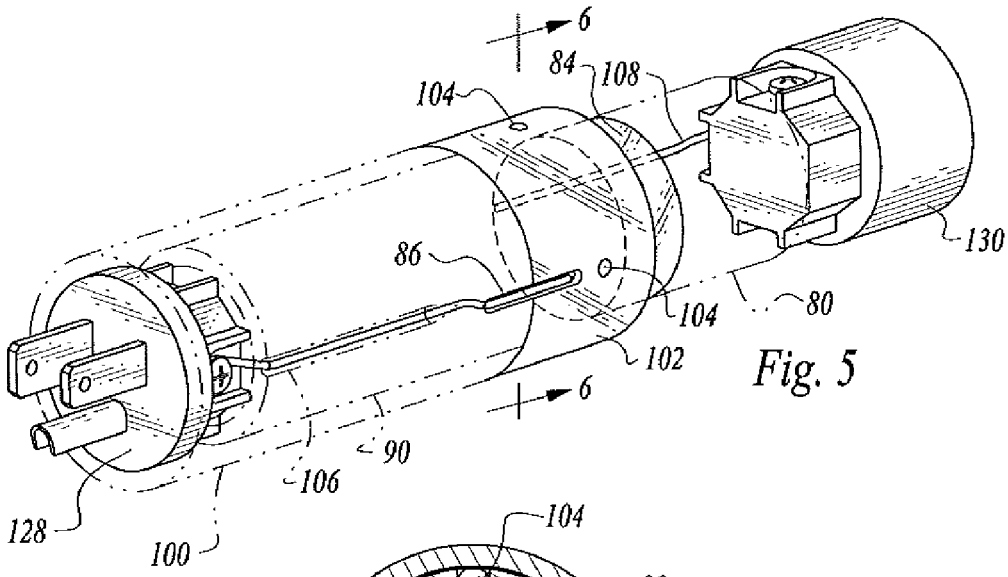
FIG. 5 is a perspective view of a longitudinal 360 degree rotational electrical connection for a third contact element of an embodiment of rotating electric connection assembly 10, depicting conductive leads 86 and 108 each communicating with conductive bands 102 and 84, respectively, on ends of cylinder housings 100 and 80, respectively, and attached to the three prong electrical plug 128 and the three prong electrical receptor 130, respectively.
Figure 6:
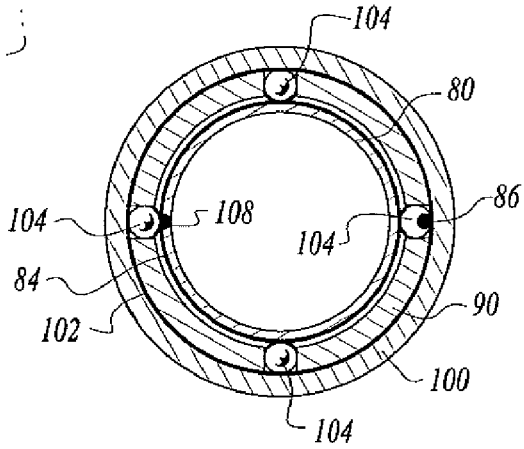
FIG. 6 is a sectional view of FIG. 5 at "6-6."

Longitudinal 360 degree rotational electrical connection for a third contact element is housed within the non-conductive first external cylindrical housing 100 and the non-conductive second external cylindrical housing 118, and is provided by an embodiment of rotating electric connection assembly 10, having a first conductive lead 86 having one end connected to a conductive band 102 on the external surface of a cylinder housing 100 and a second end connected to the three prong electrical plug 128, FIGS. 5, 6 and 13. A second conductive lead 108 has one end connected to a conductive band 84 on the external surface of internal cylinder housing 80 and a second end connected to the three prong electrical receptor 130. Connective band 102 contacts conductive band 84 by conductive bearings 104. A first longitudinal channel is provided along the first external cylindrical housing 100 conductive band outer second end terminating in an opening 104 on an inside surface of the first external cylindrical housing 100, the first longitudinal channel and opening 104 sized to receive and house a portion of the first conductive lead 86, FIGS. 5 and 6. A second longitudinal channel 106 is provided along an outside surface of the non-conductive second internal cylindrical housing 90. The second longitudinal channel 106 is sized to receive and house a portion of the first conductive lead 86, FIGS. 5 and 6. This assembly provides third contact element conductivity continuity throughout the embodiment of rotating electric connection assembly 10 by allowing separate rotation of the first cylinder connector housing 100 and cylinder housing 80, FIGS. 5, 6 and 13.

Figure 2:
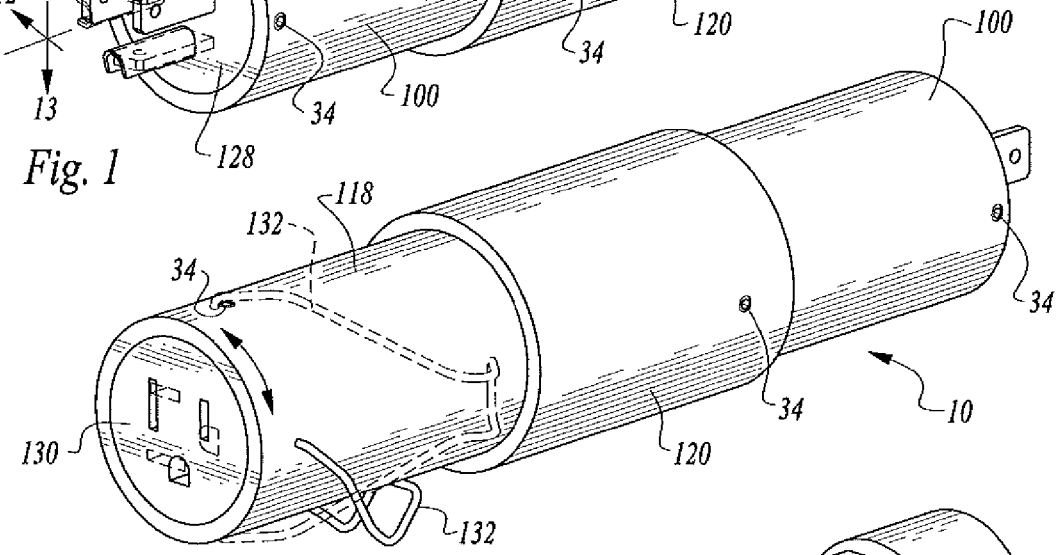
FIG. 2 is a perspective view of an embodiment of rotating electric connection assembly 10 ready for use by plugging a three prong electrical plug of an electric cord for an electrical hand held tool into the three prong electrical receptor 130 and securing the connection by the locking element for the three prong electrical receptor 132.

FIGS. 1 and 2 illustrate the positions for the rotating electric connection assembly 10 cylindrical connector housings 100, 118, and 120 for full 360 degree rotation range along the longitudinal axis 124. This freedom of rotational moment allows each operable end, 128 and 130, of the rotating electric connection assembly 10 to remain connectively attached to an electrical outlet or drop cord plug while being rotated in directions away from the other in a configuration dictated by the user's particular situation.

The conductive components of the rotating electric connection assembly 10 must be chosen for their physical strength and electrical conductivity. The conductive components, such as conductive leads 86 and 108, central bearing 60, conductive bands 84 and 102, conductive bearings 104, conductive housings 46, 48, and 54, internal channel threaded cylinder 22, and connectors leads 40, and 44, and rotor bearing assemblies 30 and 42 can be made from various metals typically used in electrical sockets.

Cylindrical housings 80, 90, 100, 118, and 120 and internal channel 26 are non-conductive portions of the body and the rotating electric connection assembly 10 and can be made from various plastics known to be suitable in this type of application.

With respect to the above description then, it is to be realized that the optimum material and dimensional relationships for the parts of the rotating electric connection assembly 10 will include variations in size, materials, shape, and form, which will occur to those skilled in the art upon review of the present disclosure. For example the length of the cylindrical connector housings 100, 118, and 120 can be varied. Similarly, diameters of the cylindrical connector housings 100, 118, and 120 can be varied so long as the respective relationship of the longitudinal 360 degree rotational electrical connections for the contained contacts and spatial relationships among and between cylindrical housings are maintained within the housings as disclosed.

Furthermore, the rotating electric connection assembly 10 can be adapted for use as the female end of an electrical cord or similar extension device, including both flexible and rigid extensions.

All equivalent relationships to those illustrated in the drawings and described in the specification are intended to be encompassed by the present invention.

I claim:

1. A rotating electric connection socket assembly comprising in combination:

a) a rotatable housing assembly comprising a longitudinal centerline a first end and a second end;

b) a first isolated and rotatable electrical contact assembly within the rotatable housing assembly centered along the rotatable housing assembly longitudinal centerline, the first contact assembly comprising two ends;

c) a second isolated and rotatable electrical contact assembly within the rotatable housing assembly centered along the rotatable housing assembly longitudinal centerline, the second contact assembly comprising two ends;

d) a third isolated and rotatable longitudinal electrical contact assembly within the rotatable housing assembly centered along the rotatable housing assembly longitudinal centerline, the third contact assembly comprising two ends;

e) a three prong electrical plug connected to one end of the first, second, and third isolated and rotatable electrical contact assemblies within the rotatable housing assembly and attached to the rotatable housing assembly first end; and f) a three prong electrical receptor connected to one end of the first, second, and third isolated and rotatable electrical contact assemblies within the rotatable housing assembly and attached to the rotatable housing assembly second end.

2. The rotating electric connection socket assembly of claim 1, wherein the rotatable housing assembly comprises in combination:

a) a non-conductive first internal cylindrical housing longitudinally aligned on the rotatable housing assembly centerline, the first cylindrical internal housing comprising a first end and a second end, and further comprising a first conductive band around an outer second end surface;

b) a non-conductive second internal cylindrical housing longitudinally aligned on the rotatable housing assembly centerline, the second cylindrical internal housing comprising a first end and a second end;

c) a non-conductive first external cylindrical housing longitudinally aligned on the rotatable housing assembly centerline, the first cylindrical external housing comprising a locking first end and a second end, and further comprising a second conductive band around an outer second end surface and conductive bearings communicating with the first internal cylindrical housing conductive band outer second end surface and the first external cylindrical housing conductive band outer second end surface, and housing the three prong electrical plug in the first external cylindrical housing locking first end;

d) a non-conductive second external cylindrical housing longitudinally aligned on the rotatable housing assembly centerline, the second cylindrical external housing comprising a first end and a locking second end and housing the three prong electrical receptor in the second external cylindrical housing locking second end; and e) a non-conductive third external cylindrical housing longitudinally aligned on the rotatable housing assembly centerline, the third cylindrical external housing comprising a first end and a locking second end, the third external cylindrical housing sized to receive and connectedly house the first external cylindrical housing second end and the second external cylindrical housing comprising a first end.

3. The rotating electric connection socket assembly of claim 2, wherein the first isolated and rotatable electrical contact assembly comprising two ends comprises in combination:

a) a conductive central bearing assembly comprising an annular center, a first conductive end, and a second conductive end;

b) a first conductive lead comprising two ends;

c) a second conductive lead comprising two ends;

d) a first conductive lead end affixed to the central bearing first conductive end and a first conductive lead end affixed to the three prong electrical plug; and d) a second conductive lead end affixed to the central bearing second conductive end and a second conductive lead end affixed to the three prong electrical receptor.

4. The rotating electric connection socket assembly of claim 2, wherein the second isolated and rotatable electrical contact assembly comprising two ends comprises in combination:

a) a non-conductive cylinder having a central channel;

b) a conductive externally threaded rod comprising two ends and an even diameter sized to be received within the non-conductive cylinder central channel such that equal threaded rod lengths extend on either side of the non-conductive cylinder;

c) two internally threaded bolts sized to secure the rod on either side of the non-conductive cylinder such that equal threaded rod lengths extend beyond the bolts;

d) two first conductive housings, each first conductive housing comprising a threaded end sized to receive and be secured to the threaded rod length extending beyond the bolt and an open end;

e) two conductive rotor bearing assemblies, each rotor bearing assembly comprising a first end sized to correspond to and be received in the first conductive housing open end and a second cylindrical end;

f) two second conductive housings, each conductive housing sized to receive and secure the rotor bearing second cylindrical end by a second conductive housing fastener assembly;

g) insular sleeves sized to wrap all conductive elements of the second isolated and rotatable electrical contact assembly;

h) means for connecting one second conductive housing to the three prong electrical plug; and i) means for connecting the other second conductive housing to the three prong electrical receptor.

5. The rotating electric connection socket assembly of claim 2, wherein the third isolated and rotatable electrical contact assembly comprising two ends comprises in combination:

a) a first conductive lead comprising two ends, with one first conductive lead end communicating with the first conductive band around the first internal cylindrical housing second end surface, and the other first conductive lead end affixed to the three prong electrical receptor;

b) a second conductive lead comprising two ends, with one second conductive lead end communicating with the second conductive band around first external cylindrical housing outer second end surface, and the other second conductive lead end affixed to the three prong electrical plug.

6. The rotating electric connection socket assembly of claim 2, wherein the first isolated and rotatable electrical contact assembly comprising two ends is housed in the non-conductive first internal cylindrical housing and the non-conductive second internal cylindrical housing.

7. The rotating electric connection socket assembly of claim 6, wherein the central bearing assembly annular center houses a non-conductive cylinder having a central channel and the second isolated and rotatable electrical contact assembly is housed in the non-conductive first internal cylindrical housing and the non-conductive second internal cylindrical housing.

8. The rotating electric connection socket assembly of claim 5, wherein the third isolated and rotatable electrical contact assembly is housed within the non-conductive first external cylindrical housing and the non-conductive second external cylindrical housing and wherein the third isolated and rotatable electrical contact assembly and rotatable housing assembly further comprise in combination:

a) a first longitudinal channel along the first external cylindrical housing conductive band outer second end terminating in an opening on an inside surface of the first external cylindrical housing, the first longitudinal channel and opening sized to receive and house a portion of the first conductive lead; and b) a second longitudinal channel along an outside surface of the non-conductive second internal cylindrical housing, the second longitudinal channel sized to receive and house a portion of the first conductive lead.

9. A rotating electric connection socket assembly comprising in combination:

a) a first rotatable housing assembly comprising a first and a second non-conductive cylindrical housing longitudinally aligned in series on a first rotatable housing assembly centerline, both first and second cylindrical housings comprising a first end and a second end, the second cylindrical housing further comprising a conductive band around a first end outer surface and a second end housing a contact element end of a three prong electrical plug, and the first cylindrical housing comprising a first end housing a contact element end of a three prong electrical receptor;

b) a first isolated and rotatable electrical contact assembly connecting corresponding first contact elements between the three prong electrical plug and the three prong electrical receptor, the first isolated and rotatable contact assembly comprising a conductive central bearing assembly disposed between the second end of the first non-conductive cylindrical housing and the first end of the second non-conductive cylindrical housing, the central bearing assembly comprising an annular center, a first conductive end, and a second conductive end, a first conductive lead and connector assembly connecting the central bearing first conductive end to the contact element of the three prong electrical plug, and a second conductive lead and connector assembly connecting the central bearing first conductive end to the corresponding contact element of the three prong electrical receptor;

c) a second isolated and rotatable electrical contact assembly connecting corresponding second contact elements between the three prong electrical plug and the three prong electrical receptor, the second isolated and rotatable contact assembly comprising a non-conductive cylinder disposed within the first isolated and rotatable electrical contact assembly conductive central bearing assembly, the non-conductive cylinder housing a conductive externally threaded rod extending equal-distance from non-conductive cylinder ends and secured thereto by two internally threaded bolts, a first conductive housing threaded on each extended threaded rod end and each housing a conductive rotor bearing having a conductive cylindrical end, a second conductive housing each conductive rotor bearing cylindrical end and securing the cylindrical end by a fastener assembly, means for connecting the second connective housings to corresponding second contact elements of three prong electrical plug and the three prong electrical receptor, respectively, and means for insulating all conductive elements of the second isolated and rotatable electrical contact assembly;

d) a second rotatable housing assembly sized to house the first rotatable housing assembly and comprising a third and a fourth non-conductive cylindrical housing longitudinally aligned in series on the first rotatable housing assembly centerline, both third and fourth cylindrical housings comprising a first end and a second end, the third cylindrical housing further comprising a conductive band around second end outer surface, conductive bearings communicating with the second cylindrical housing conductive band and the third cylindrical housing conductive band, and a first end comprising a locking assembly and housing a three prong electrical plug, and the fourth cylindrical housing comprising a second end comprising a locking assembly and housing a three prong electrical receptor, whereby the longitudinally aligned second rotatable housing assembly further houses the first rotatable housing assembly;

e) a third isolated and rotatable electrical contact assembly connecting corresponding third contact elements between the three prong electrical plug and the three prong electrical receptor, the third isolated and rotatable contact assembly comprising a first conductive lead comprising two ends, one first conductive lead end communicating with the conductive band around the second cylindrical housing first end outer surface, and the other first conductive lead end affixed to the three prong electrical receptor, and a second conductive lead comprising two ends, one second conductive lead end communicating with the conductive band around the third cylindrical housing second end outer surface, the second conductive lead passing through an opening in the third cylindrical housing and housed within a longitudinal channel on an inside surface of the third cylindrical housing and a corresponding longitudinal channel on an outside surface of the first cylindrical housing, and the other second conductive lead end affixed to the three prong electrical plug; and f) a fifth non-conductive cylindrical housing longitudinally aligned on the first rotatable housing assembly centerline comprising a locking assembly for the fourth cylindrical housing and housing an interface between the third cylindrical housing and the fourth cylindrical housing allowing 360 degree rotation between the third cylindrical housing and the fourth cylindrical housing.

10. A rotating electric connection socket assembly comprising in combination:

a) a non-conductive first internal cylindrical housing longitudinally aligned on the rotatable housing assembly centerline, the first cylindrical internal housing comprising a first end and a second end, and further comprising a first conductive band around an outer second end surface;

b) a non-conductive second internal cylindrical housing longitudinally aligned on the rotatable housing assembly centerline, the second cylindrical internal housing comprising a first end and a second end;

c) a non-conductive first external cylindrical housing longitudinally aligned on the rotatable housing assembly centerline, the first cylindrical external housing comprising a locking first end and a second end, and further comprising a second conductive band around an outer second end surface and conductive bearings communicating with the first internal cylindrical housing conductive band outer second end surface and the first external cylindrical housing conductive band outer second end surface, and housing an electrical plug in the first external cylindrical housing locking first end;

d) a non-conductive second external cylindrical housing longitudinally aligned on the rotatable housing assembly centerline, the second cylindrical external housing comprising a first end and a locking second end and housing an electrical receptor in the second external cylindrical housing locking second end; and e) a non-conductive third external cylindrical housing longitudinally aligned on the rotatable housing assembly centerline, the third cylindrical external housing comprising a first end and a locking second end, the third external cylindrical housing sized to receive and connectedly house the first external cylindrical housing second end and the second external cylindrical housing comprising a first end;

f) a plurality of isolated and rotatable electrical contact assemblies each comprising two ends with one set of electrical contact assembly ends connected to the electrical plug and the other set of electrical contact assembly ends electrical connected to the electrical receptor, with all of the electrical contact assemblies housed within the cylindrical housings.

11. The rotating electric connection socket assembly of claim 10, wherein at least one first isolated and rotatable electrical contact assembly is housed within the non-conductive first internal cylindrical housing and the non-conductive second internal cylindrical housing and comprises in combination:

a) a conductive central bearing assembly comprising an annular center, a first conductive end, and a second conductive end;

b) a first conductive lead comprising two ends;

c) a second conductive lead comprising two ends;

d) a first conductive lead end affixed to the central bearing first conductive end and a first conductive lead end affixed to the electrical plug; and d) a second conductive lead end affixed to the central bearing second conductive end and a second conductive lead end affixed to the electrical receptor.

12. The rotating electric connection socket assembly of claim 11, wherein at least one second isolated and rotatable electrical contact assembly is housed within the non-conductive first internal cylindrical housing and the non-conductive second internal cylindrical housing and comprises in combination:

a) a non-conductive cylinder having a central channel, the cylinder housed within the conductive central bearing assembly annular center;

b) a conductive externally threaded rod comprising two ends and an even diameter sized to be received within the non-conductive cylinder central channel such that equal threaded rod lengths extend on either side of the non-conductive cylinder;

c) two internally threaded bolts sized to secure the rod on either side of the non-conductive cylinder such that equal threaded rod lengths extend beyond the bolts;

d) two first conductive housings, each first conductive housing comprising a threaded end sized to receive and be secured to the threaded rod length extending beyond the bolt and an open end;

e) two conductive rotor bearing assemblies, each rotor bearing assembly comprising a first end sized to correspond to and be received in the first conductive housing open end and a second cylindrical end;

f) two second conductive housings, each conductive housing sized to receive and secure the rotor bearing second cylindrical end by a second conductive housing fastener assembly;

g) insular sleeves sized to wrap all conductive elements of the second isolated and rotatable electrical contact assembly;

h) means for connecting one second conductive housing to the three electrical plug; and i) means for connecting the other second conductive housing to the electrical receptor.

13. The rotating electric connection socket assembly of claim 10, wherein at least one third isolated and rotatable electrical contact assembly is housed within the non-conductive first external cylindrical housing and the non-conductive second external cylindrical housing and comprises in combination:

a) a first conductive lead comprising two ends, with one first conductive lead end communicating with the first conductive band around the first internal cylindrical housing second end surface, and the other first conductive lead end affixed to the electrical receptor;

b) a second conductive lead comprising two ends, with one second conductive lead end communicating with the second conductive band around first external cylindrical housing outer second end surface, and the other second conductive lead end affixed to the electrical plug.

14. The rotating electric connection socket assembly of claim 13 further comprising in combination:

a) a first longitudinal channel along the first external cylindrical housing conductive band outer second end terminating in an opening on an inside surface of the first external cylindrical housing, the first longitudinal channel and opening sized to receive and house a portion of the third isolated and rotatable electrical contact first conductive lead; and b) a second longitudinal channel along an outside surface of the non-conductive second internal cylindrical housing, the second longitudinal channel sized to receive and house a portion of the third isolated and rotatable electrical contact first conductive lead.

* * * * *

UNITED STATES PATENT AND TRADEMARK OFFICE

CERTIFICATE OF CORRECTION

PATENT NO. : 7,819,665 B1
APPLICATION NO. : 12/722866
DATED : October 26, 2010
INVENTOR(S) : John Nishizawa It is certified that error appears in the above-identified patent and that said Letters Patent is hereby corrected as shown below:

In Claim 3, column 9, line 29, delete "d)" and substitute --e)--;

In Claim 5, column 10, line 6, add --and-- after the ";";

In Claim 10, column 12, line 31, delete "and";

In Claim 10, column 12, line 39, add --and-- after the ";";

In Claim 11, column 12, line 62, delete "d)" and substitute --e)--; and

In Claim 13, column 14, line 11, add --and-- after the ";".

Signed and Sealed this
Fifteenth Day of March, 2011

David J. Kappos

David J. Kappos
*Director of the United States Patent and Trademark Office*